US007318656B1

(12) United States Patent
Merine

(10) Patent No.: US 7,318,656 B1
(45) Date of Patent: Jan. 15, 2008

(54) ILLUMINATING BOTTLE CLOSURE

(76) Inventor: Frantz Merine, 7 Sunderland Pl., Suffern, NY (US) 10901

( * ) Notice: Subject to any disclaimer, the term of this patent is extended or adjusted under 35 U.S.C. 154(b) by 81 days.

(21) Appl. No.: 11/202,738

(22) Filed: Aug. 11, 2005

(51) Int. Cl.
*F21V 33/00* (2006.01)

(52) U.S. Cl. ..... 362/154; 362/806

(58) Field of Classification Search ..... None
See application file for complete search history.

(56) References Cited

U.S. PATENT DOCUMENTS 4,513,870 A * 4/1985 Zaltsman ..... 215/46
5,178,450 A * 1/1993 Zelensky et al. ..... 362/154
6,902,304 B2 * 6/2005 Yang ..... 362/362
7,040,776 B2 * 5/2006 Harrell et al. ..... 362/154
2005/0194402 A1 * 9/2005 Morrison ..... 222/113
2007/0008718 A1 * 1/2007 Cayton ..... 362/186

* cited by examiner

*Primary Examiner*—Sandra O'Shea
*Assistant Examiner*—Kristen A Manskar

(57) ABSTRACT

An illuminating bottle closure is removably couplable to a mouth or opening of a bottle. The illuminating bottle closure has a stopper portion that is insertable into the opening of the bottle and a flange portion radiating outwardly from the stopper portion for resting upon a lip of the bottle. A light emitting source and a power source are disposed in the illuminating bottle closure for emitting light into an interior of the bottle. An actuating assembly is also disposed to the illuminating bottle closure for selectively controlling power to the light emitting source. By illuminating a bottle from its interior, the illuminating bottle closure creates an enjoyable visual experience by creating the appearance that the bottle is glowing.

19 Claims, 9 Drawing Sheets

ILLUMINATING BOTTLE CLOSURE

FIELD OF THE INVENTION

The present invention relates generally to illuminating devices. More specifically, this invention relates to an illuminating bottle closure that illuminates the interior of the bottle and its contents when it is inserted into an opening or mouth of a bottle.

BACKGROUND OF THE INVENTION

The use of various bottle illuminating devices for illuminating bottles and its contents are known. There are two typical types of illuminating devices that are used to illuminate bottles and its contents. Both illuminating devices typically include a lamp and a light bulb. In the first typical illuminating device the lamp is typically hung from a ceiling or wall and the light from the light bulb is directed toward the bottle. The problem with illuminating a bottle with this illuminating device is that much of the light scatters before it contacts the bottle. Some of the light contacting the bottle is refracted by the glass thereby creating an appearance of refracted light instead of an illumination or glowing of the bottle.

The second typical illuminating device includes a lamp or base that has a light bulb positioned in an interior. The bottle to be illuminated is positioned on the base and the light bulb emits light upward through the base and onto the bottom of the bottle. Although this typical illuminating device is adequate for its intended purpose, it requires an outlet and electricity to power the lamp. This is particularly a problem where there are a lot of bottles that need to be illuminated.

A user typically illuminates a bottle or multiple bottles to create a visual impact or experience for a customer. If multiple bottles are to be illuminated, a user will need multiple outlets to power all of the lamps. Bottles that are illuminated by typical illuminating devices can impact negatively on the visual experience for the customer. The customer can typically see the lamps that are illuminating the bottles. Additionally, the light that is refracted by a lamp outside of the bottle can create an unpleasant glare. What is needed is an illuminating device that can illuminate a bottle from the inside of the bottle without a need for electric cords and outlets. What is also needed is an improved bottle illuminating device that creates the appearance of the illuminated bottle glowing.

BRIEF SUMMARY OF THE INVENTION

In an embodiment according to the invention, the illuminating bottle closure is removably couplable to a mouth or opening of a bottle. The illuminating bottle closure has a stopper portion that is insertable into the opening of the bottle and a flange portion radiating outwardly from the stopper portion for resting upon a lip of the bottle. A light emitting source and a power source are disposed in the illuminating bottle closure for emitting light into an interior of the bottle. An actuating member is also disposed to the illuminating bottle closure for selectively controlling power to the light emitting source. By illuminating a bottle from its interior, the illuminating bottle closure creates an enjoyable visual experience by creating the appearance that the bottle is glowing.

The above summary of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
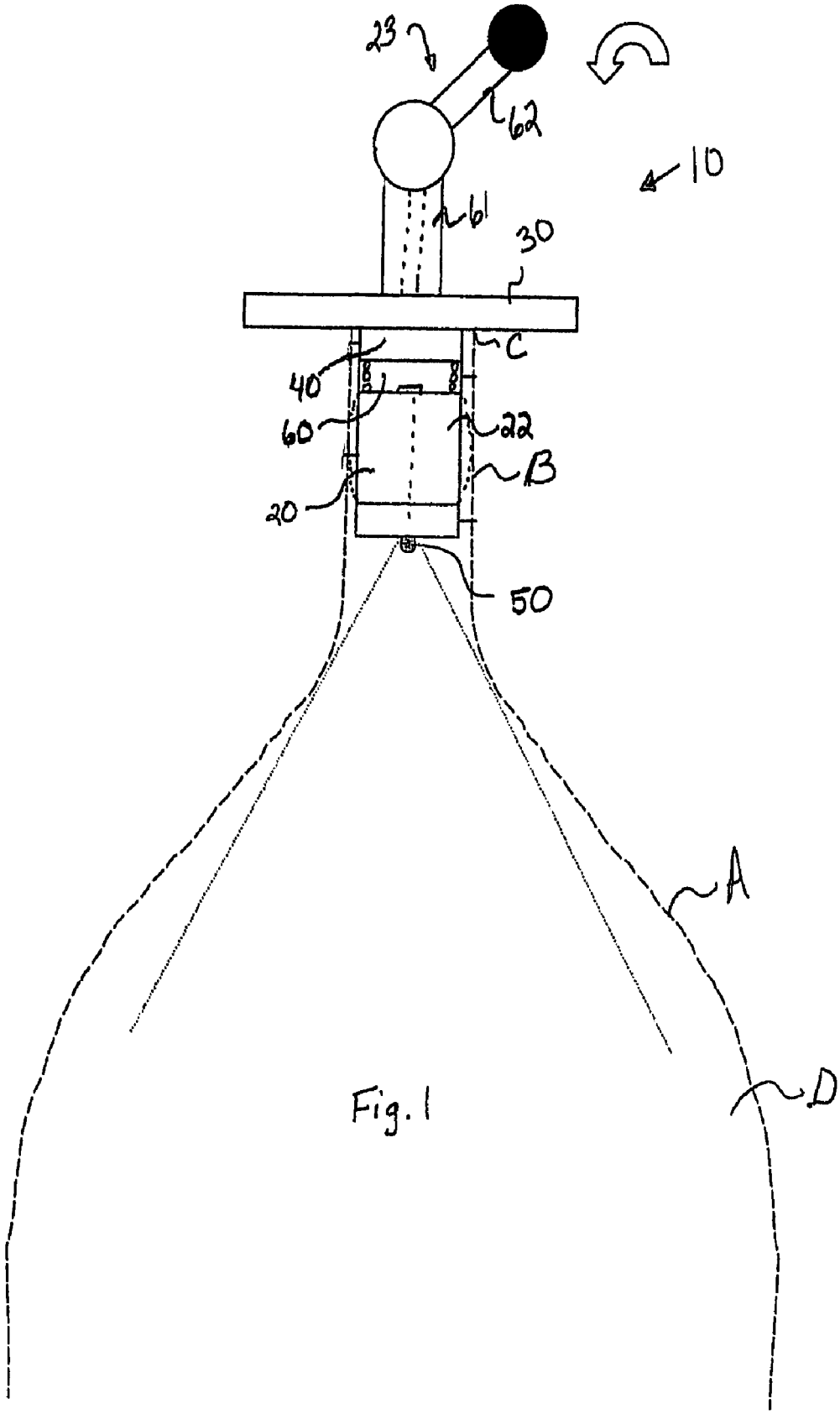
FIG. 1 is a side view of one embodiment according to the invention showing a stopper portion inserted into an opening of a bottle, a light emitting source directed into an interior of the bottle and a topper portion mounted on an end of the stopper portion.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents and alternatives falling within the spirit and scope of the invention as defined by the appended claims.

DETAILED DESCRIPTION OF THE DRAWINGS

Referring to FIG. 1, a bottle illuminating device is provided for illuminating a bottle, indicated by the letter A, from its interior. Bottles A typically include a neck portion B having an opening or mouth C that provides access into an interior D of the bottle A. By illuminating Bottle A from the interior D, a user can create a glowing effect of the bottle and impart a visual impact upon a viewer. An example embodiment of the illuminating bottle closure is illustrated in FIGS. 1-4 and generally indicated by the numeral 10.

Figure 2:
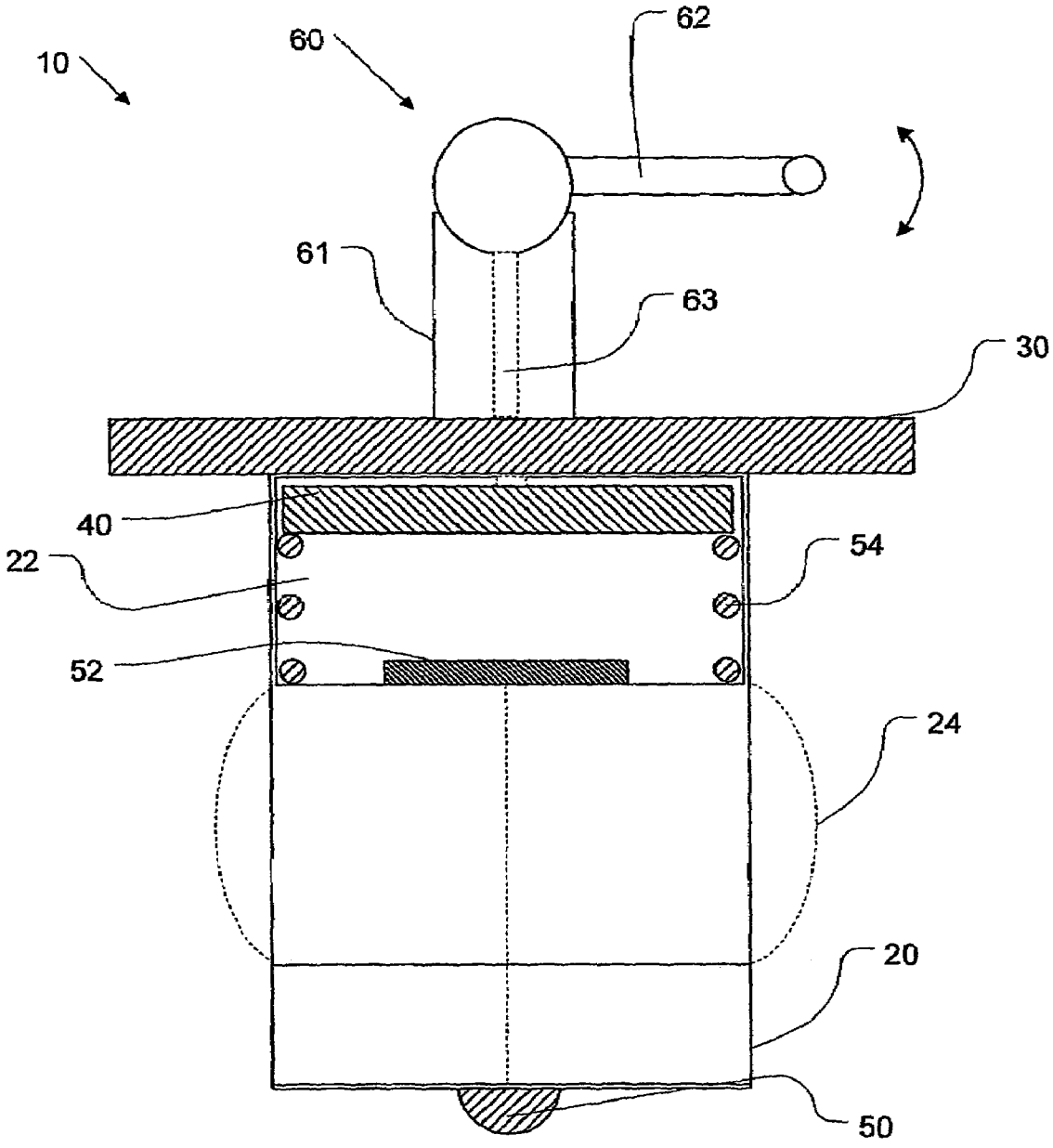
FIG. 2 is a cross sectional view of the illuminating bottle closure showing a power supply biased in the stopper portion and an expanded section of the stopper portion.
Figure 3:
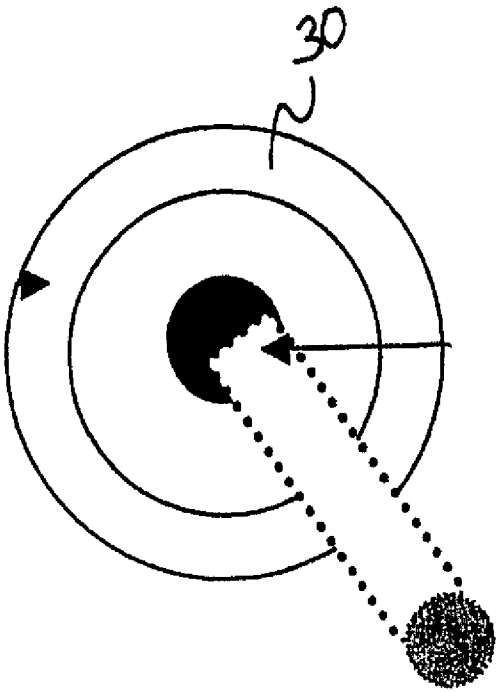
FIG. 3 is a top view of the embodiment of FIG. 1 showing a flange portion of the illuminating bottle closure and a lever or an actuating assembly pivotally coupled to the flange portion for selectively controlling the illuminating bottle closure.
Figure 4:
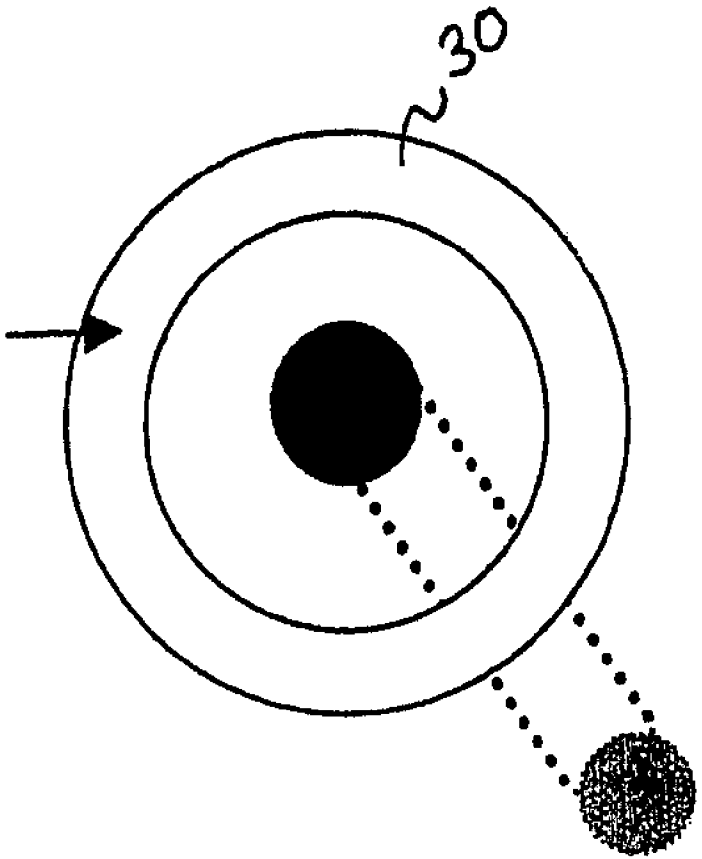
FIG. 4 is a bottom view of the embodiment of FIG. 1 showing the light emitting source disposed on an end of the stopper portion.

Referring particularly to FIGS. 1 and 2, in this particular embodiment of the bottle illuminating closure 10 includes a stopper portion 20 that is removably insertable into the mouth or opening of the bottle for stopping the contents of the bottle from flowing out. A flange portion 30 is disposed at one end of the stopper portion 20 and radiates generally perpendicularly outward therefrom for restricting movement of stopper portion 20 into the interior of the bottle. Stopper portion 20 preferably has a generally hollow interior portion 22. In this embodiment, a power supply 40 is slidably disposed in interior 22 of stopper portion 20. The power supply is preferably slidable along a longitudinal axis of stopper portion 20. A light source 50 disposed on a free end 23 of stopper portion 20 for illuminating the interior of the bottle. An actuating assembly 60 is disposed on flange portion 30 for controlling a flow of power between power supply 40 and light source 50.

In one embodiment, as illustrated in FIGS. 1 and 2, stopper portion 20 may include an expandable section 24 generally disposed between power supply 40 and light source 50 to expand to an inner diameter of the bottle and securing stopper portion 20 therein. Expandable section 24 expands outwardly in all directions from stopper portion 20 to fill any gap between stopper portion 20 and an inner surface of the bottle. Expandable section 24 may be made of a resiliently flexible material such as rubber. However, other materials may also be used and are envisioned within the scope and spirit of the invention.

In this particular embodiment, actuating assembly 60 is preferably used to expand expandable section 24 and illuminate light source 50. Referring to FIGS. 1-4 and particularly to FIGS. 1 and 2, actuating assembly 60 may include post 61 disposed on flange portion 30 and extending axially away therefrom and a lever 62 operably coupled to post 61. A shaft 63 is slidably disposed in post 61 and operably coupled to lever 62 such that when lever 62 is actuated, shaft 63 confronts and displaces power supply 40 in stopper portion 20, such that power supply 40 abuts a contact 52 that is in electrical communication with light source 50. Contact 52 preferably rests upon expandable section 24 such that when power supply 40 confronts contact 52, contact 52 compresses and expands expandable section 24.

Power supply 40 is preferably displacable between an off position, wherein power supply 40 is positioned generally adjacent to flange portion 30, and an on position, wherein power supply 40 is positioned generally adjacent to and generally confronting contact 52. As particularly illustrated in FIG. 2, a biasing member 54 is preferably disposed between power supply 40 and expandable section 24 of stopper portion 20, wherein biasing member 54 biases power supply 40 from the on position toward the off position. Biasing member 54 preferably comprises a coil spring; however, other types of biasing members are also envisioned within the spirit and scope of the invention.

In another embodiment of the invention, stopper portion 20 may be detachably coupled to flange 30 for providing access to power supply 40 and light source 50. The juncture between stopper portion 20 and flange 30 is preferably sealed to prevent the contents of the bottle to enter into stopper portion 20. A seal may be disposed about stopper portion 20 to effectively block entry of the bottle's contents. An upper surface of flange 30 is may also have an area suitable for imprinting or receiving a marketing substrate.

Figure 5:
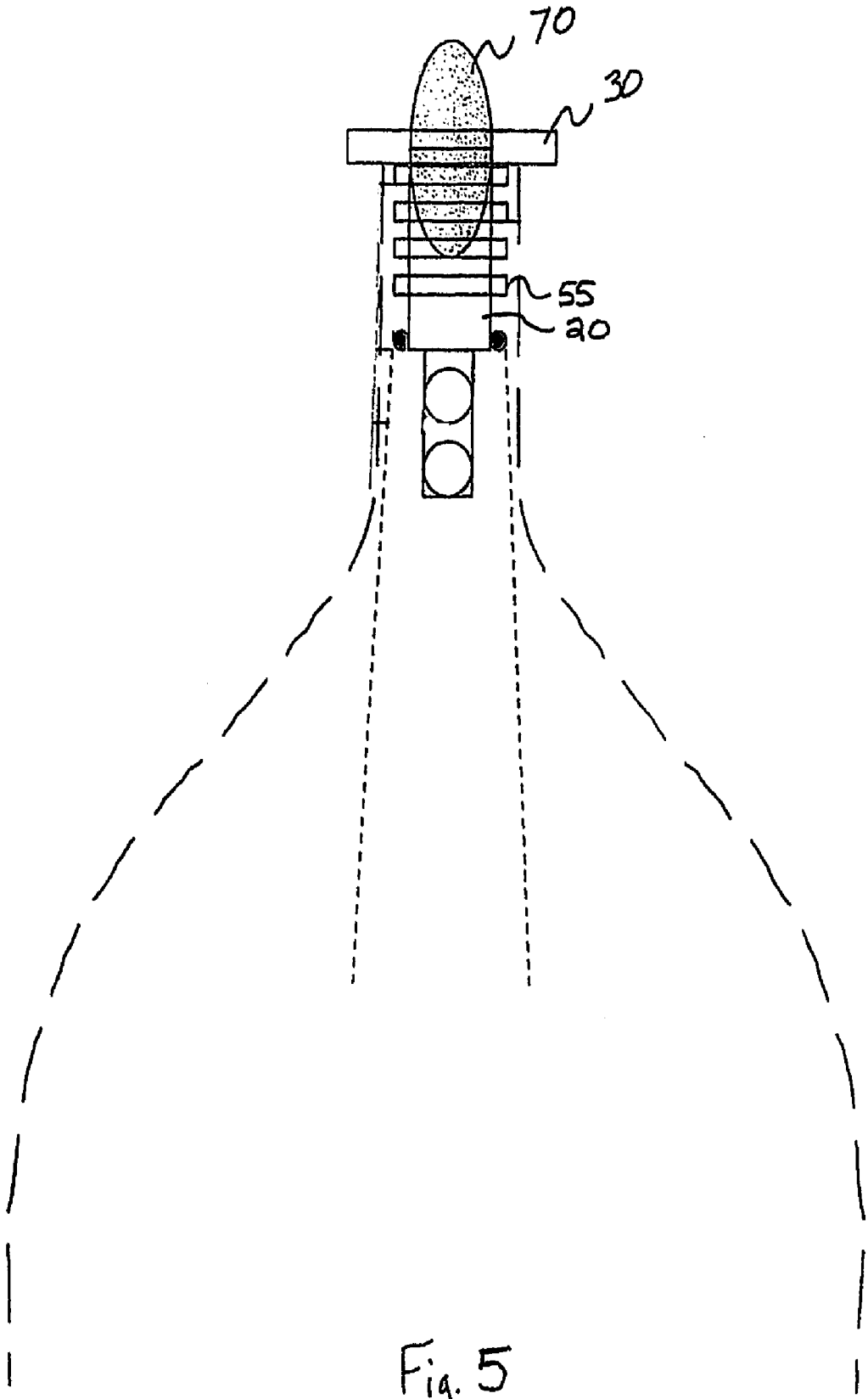
FIG. 5 is a side view of another embodiment of the invention showing a stopper portion, a topper portion disposed on an end of the stopper portion.
Figure 6:
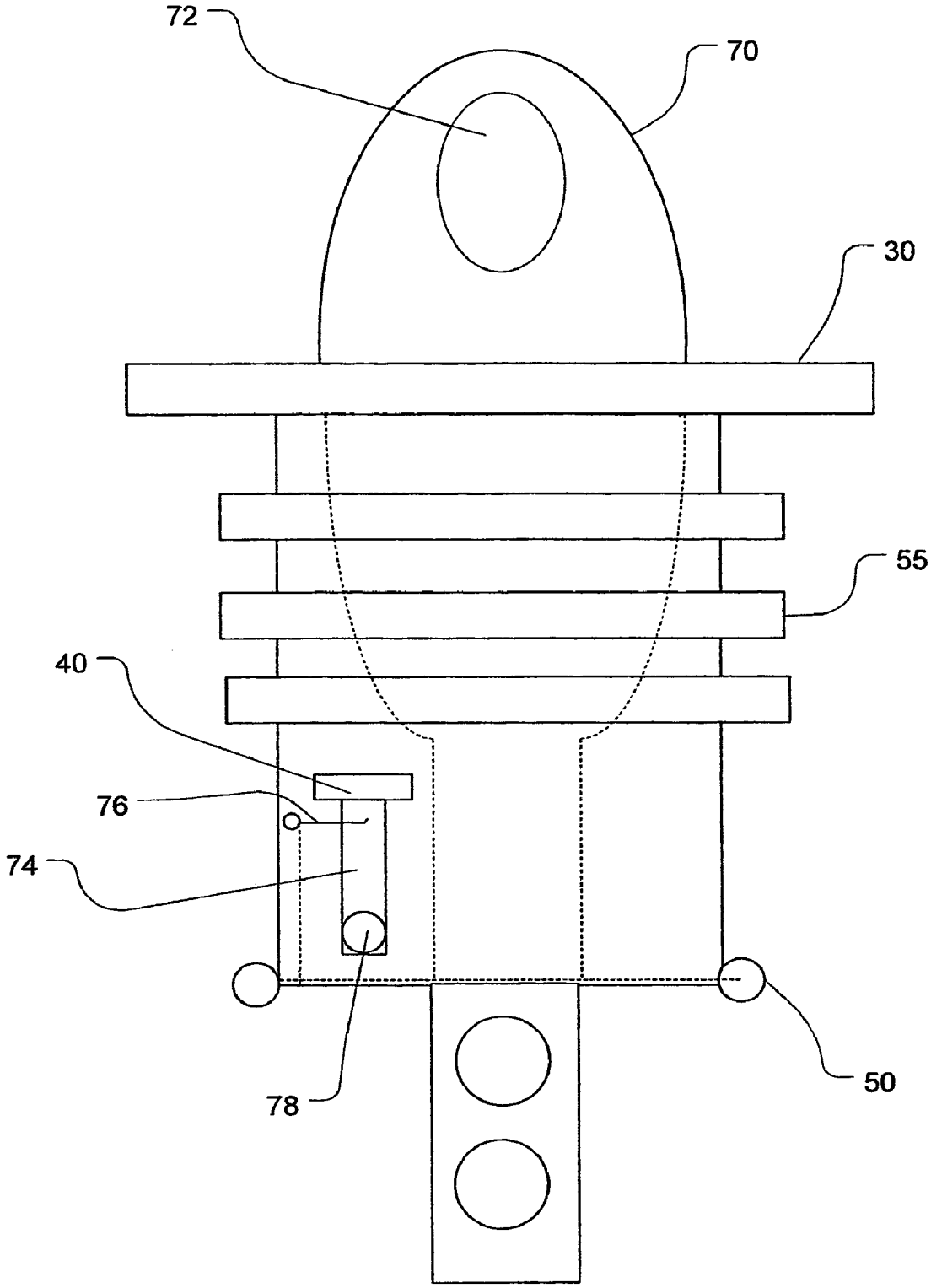
FIG. 6 is an enlarged side view of Figure one detailing the actuating assembly disposed in the stopper portion.
Figure 7:
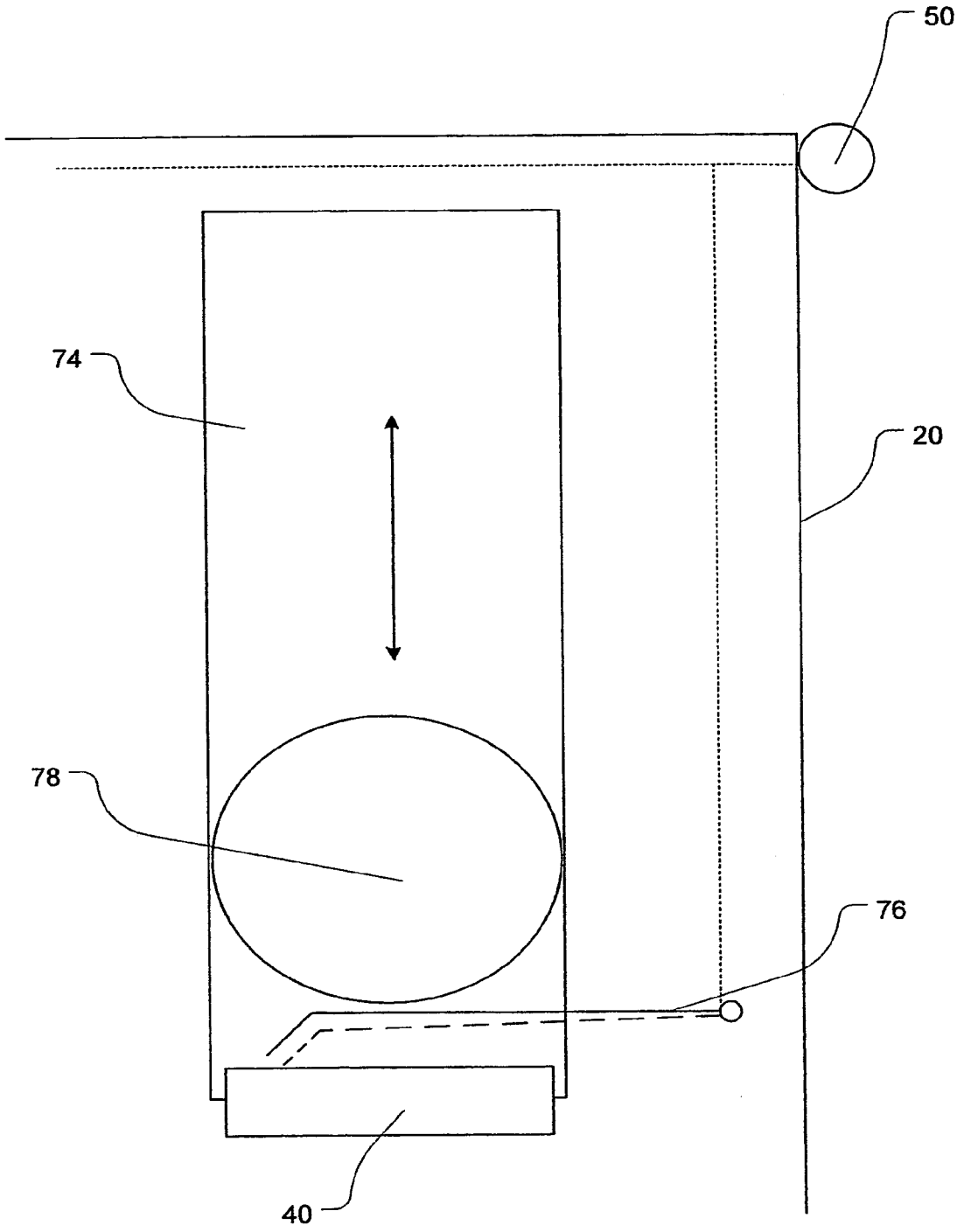
FIG. 7 is an enlarged partial view of FIG. 6 showing the actuating assembly.

In yet another embodiment, as illustrated in FIGS. 5-7, stopper portion 20 may include at least one generally perpendicularly outward radiating rib 55 for filling a gap between stopper portion 20 and an inner surface of the bottle, thereby selectively blocking an outward flow of the bottle's contents. In addition to filling a gap between stopper portion 20 and the inner surface of the bottle, rib 55 releasably secures stopper portion 20 in the neck of the bottle. As particularly illustrated in FIGS. 5 and 6, a plurality of ribs 55 may be used to ensure that gap between stopper portion 20 and that stopper portion 20 does not fall out of the bottle. Rib 55 is preferably made from a generally flexible material such has plastic or rubber; however, other materials may also be used.

In this particular embodiment, a spout 70 may be disposed on and extend axially away from flange portion 30. Spout 70 generally encircles a channel 72 that extends axially through flange portion 30 and stopper portion 20. The contents of the bottle may be poured through channel 72 and directed by spout 70.

In this embodiment, power supply 40 is removably disposed in stopper portion 20 adjacent to channel 72. Power supply 40 is disposed adjacent to actuating assembly 60 which may also be disposed in stopper portion 20. In this particular embodiment, actuating assembly 60 may include a channel, slot or bore 74 that extends generally axially in stopper portion 20 and a switch 76 pivotally coupled to stopper portion 20 for pivotally contacting power supply 40. Power supply 40 may be disposed adjacent to bore 74 and positionable generally between bore 74 and spout 70.

As particularly illustrated in FIGS. 6 and 7, actuating assembly 60 may also include an actuator 78 slidably disposed in bore 74 for pivoting switch 76 into contact with power supply 40. Actuator 78 may comprise a ball bearing or any spherical member that will easily slide in bore 74 in the direction of the arrow illustrated in FIG. 7. Other types of actuators and switches are also envisioned within the spirit and scope of the invention.

At least one light source 50 is disposed to stopper portion 20 for illuminating the interior of the bottle and its contents. The at least one light source 50 may be disposed on an outer surface or may be disposed in an interior of stopper portion 20. As particularly illustrated in FIG. 6, a plurality of light sources 50 may be disposed about an outer surface of stopper portion 20. The at least one light source 50 may comprise a light emitting diode capable of emitting any particular desired color. Spout 70 may also comprise a generally translucent material that permits it be illuminated by light source 50. Other components of bottle illuminating closure 10 may also comprise generally translucent materials capable of being illuminated by light emitted from light source 50.

Figure 8:
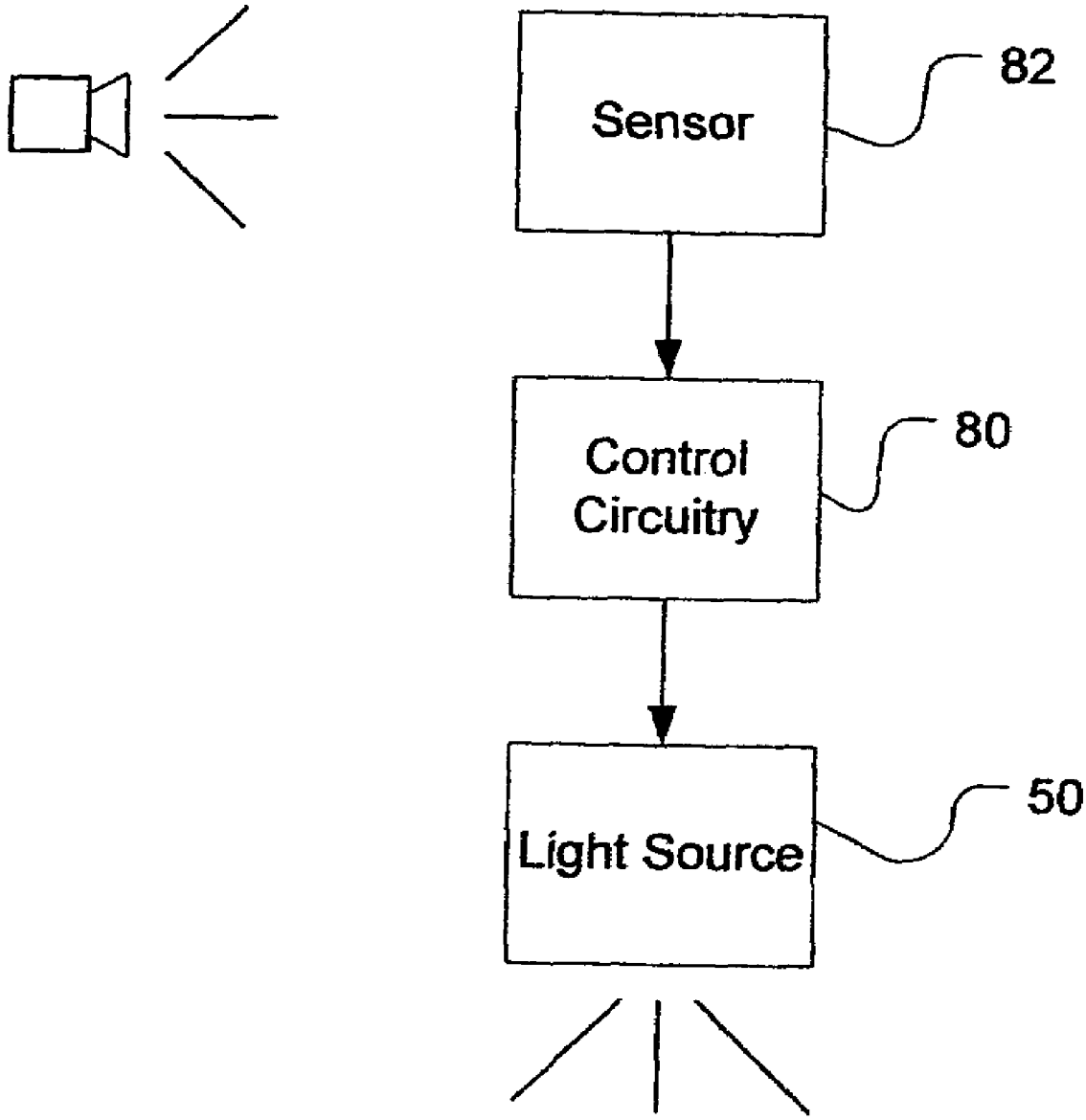
FIG. 8 is a schematic view of the light source being in communication with control circuitry and a sensor.

In yet another embodiment of the invention, control circuitry 80 is disposed to bottle illuminating closure 10 for controlling illumination of light source 50. As illustrated in FIG. 8, sound from a sound emitting source such as speakers may be received by a sensor 82, such as a microphone, that is connected to control circuitry 80. Control circuitry 80 is then coupled to and controls a flow of power from power supply 40 to light source 50. Sensor 82 and control circuitry 80 may be disposed anywhere on bottle illuminating closure 10 for instance it may be mounted on spout 70 or flange 30.

In operation, the stopper portion 20 is inserted into the opening of the bottle to block the contents from flowing out. In the embodiment illustrated in FIGS. 1 and 2, to seal the opening and illuminate the bottle, a user pivots lever 62 toward flange 30. As lever 62 is pivoted shaft 63 is slide downwardly and engages power supply 40. Power supply 40 then confronts and abuts contact 52 causing light source 50 to illuminate. As power supply 40 abuts contact 52, expandable section 24 of stopper portion 20 may become compressed and expand to engage an inner surface of the bottle.

In an embodiment illustrated by the examples depicted in FIGS. 5-7, stopper portion 20 is inserted into the opening of the bottle which causes rib 55 to confront and abut the inner surface of the bottle. Once the bottle illuminating closure 10 is inserted into the bottle inverting of the bottle will activate light source 50. In particular, as a user inverts the bottle to pour a drink, actuator 78 slides or rolls in bore 74 confronting switch 76 and causing it to pivot into and contact power supply 40. When switch 76 contacts power supply 40, light source 50 is illuminated making the bottle appear to glow. When the user finishes pouring the drink and inverts the bottle, actuator 78 rolls in bore 74 away from switch 76 which is biased away from power supply 40 and light emitting from light source 50 is terminated.

In any embodiment utilizing control circuitry 80 and sensor 82, sound from music is received by sensor 82. Control circuitry 80 transfers the sound waves into an electrical signal that activates light source 50. In this embodiment, control circuitry may cause light source 50 to illuminate in a pattern or rhythm consistent to the music. Control circuitry 80 may be programmed to illuminate light source 50 in any particular pattern and may be programmed to illuminate different color light sources 50 as a consequence of different decibel levels of the sound or music. Multiple bottles may be illuminated at different times or in concert in association with the music. The result is a visual experience for users and patrons.

Figure 9:
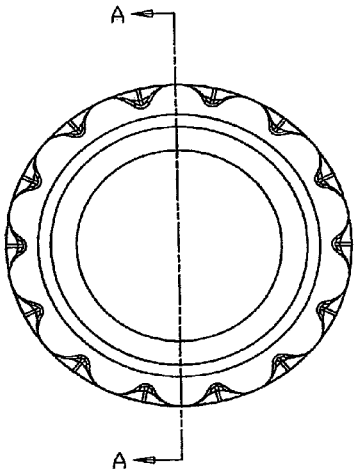
FIG. 9 is a top view of an example embodiment of the invention.
Figure 10:
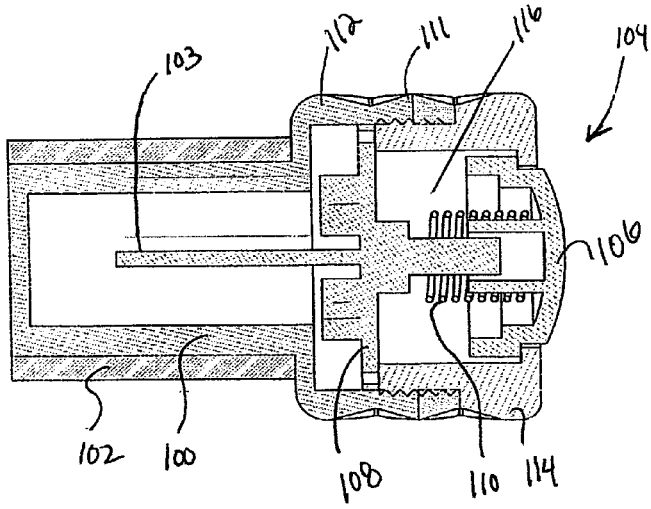
FIG. 10 is a cross section view of the embodiment of FIG. 9.

Referring to FIGS. 9 and 10, an example embodiment of the invention includes a stopper portion or member 100 that is insertable into a mouth of a bottle. In one embodiment, a sleeve 102 is disposed about the stopper member 100 to seal the mouth of the bottle. The sleeve 102 can comprise a cork material, a rubber material, a silicone material, or any other type of material capable of sealing a space between the stopper member 102 and the bottle. A light emitting member 103 such as a light bulb, light emitting diode, and the like can be disposed in the stopper member 102 to illuminate the stopper member 102 and the interior of the bottle.

An actuator assembly 104 can be operatively coupled to the stopper member 102 to allow selective control of the light emitting member 103. In one embodiment of the invention, the actuator assembly 104 includes a pushbutton, lever, turn knob, and the like switch 106 that a user can use to turn on and off the light emitting member 103. A substrate 108 can be disposed below, proximate, adjacent to the push button for holding circuitry or a contact for aiding in the regulation of selective control of the light emitting member 103. A biasing member 110 can be disposed between the switch 106 and the substrate 108 such that upon actuating the switch 106, the control circuitry or the contact is activated and the light emitting member 103 is controlled.

In one embodiment of the invention, an actuator housing 111 at least partially encloses the actuator assembly 104. The actuator housing 111 can include a base portion 112 having a diameter generally greater than a diameter of the stopper member 102. Additionally, a cap 114 can have an outer surface threadedly couplable to an inner surface of the base portion 112. In this embodiment, a user can remove cap portion 114 to gain access to an interior 116 thereof holding the substrate 108. If a user needs to change the light emitting member 103, they can lift the substrate thereby exposing the light emitting member 103. The power supply 40 can be operatively disposed in either the actuator housing 111 or the stopper member 102.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An illuminating bottle closure to illuminate a bottle having a mouth or opening providing access to an interior thereof, the illuminating bottle closure comprising:

a stopper member insertable into the mouth of the bottle, the stopper member having an interior;

an sealing member disposed on an outer surface of the stopper member to engage an inner surface of the bottle, wherein the sealing member seals contents contained in the interior of the bottle;

a light emitting member being operatively disposed in the interior of the stopper member to illuminate an end of the stopper member disposed in the interior of the bottle, whereby the bottle is illuminated; and an actuator assembly in operative communication with the light emitting member to turn the light emitting member on and off.

2. The closure of claim 1 further comprising a flange portion between the actuator assembly and the stopper member adapted to rest against a lip of the mouth of the bottle.

3. The closure of claim 1, wherein the actuator assembly comprises a power supply operatively coupled to a lever switch, wherein the lever switch turns the light emitting member on and off.

4. The closure of claim 1, wherein the actuator assembly comprises a power supply in operative communication with a pushbutton switch, wherein the pushbutton switch turns the light emitting member on and off.

5. The closure of claim 1 wherein the sealing member comprises a sleeve being disposed on an outer surface of the stopper member to seal the mouth of the bottle.

6. The closure of claim 5, wherein the sleeve is selected from the group consisting essentially of a cork material, a rubber material, and a silicon material.

7. The closure of claim 1 further comprising an expandable section operatively disposed on stopper member such that actuating the actuator member expands the expandable section against an inner surface of the bottle and illuminates the light emitting member.

8. The closure of claim 4 further comprising an actuator housing disposed on top of the stopper member, the actuator housing having an interior for housing the actuating assembly.

9. The closure of claim 1, wherein the actuator assembly comprises:

a pushbutton disposed on a first end of the stopper member;

a substrate disposed generally below the pushbutton;

a biasing member operatively disposed between the pushbutton and the substrate;

a power supply in operative communication with the substrate; and a contact disposed on the substrate such that actuation of the pushbutton closes and breaks the contact, thereby regulating a flow of power to the light emitting member.

10. The closure of claim 9 further comprising circuitry operatively disposed on substrate adapted to sound actuation, whereby the contact opens and closes in response to sounds.

11. The closure of claim 1, wherein the actuator assembly comprises:

a control circuitry in communication with a power supply such that control circuitry regulates the illumination of light emitting member upon receiving a stimulus.

12. The closure of claim 1 further comprising a spout disposed on the stopper member, the spout having a channel extending therein and through the stopper portion such that the channel is in fluid communication with the interior of the bottle.

13. The closure of claim 12 further comprising a regulator being disposed in the channel to regulate a flow of contents from the bottle and out the spout.

14. The closure of claim 12, wherein the actuator assembly comprises a pair of contacts adapted to complete a circuit thereby illuminating the light emitting member, the contact being operatively disposed on the stop member and contactable with fluid in the bottle.

15. The closure of claim 12, wherein the actuator assembly comprises a sphere displaceably disposed in a bore in the stopper member, the sphere being adapted to confront a contact, the contact being in communication with a power supply and the light emitting member such that when the bottle is inverted for pouring its contents it illuminates the light emitting member.

16. The closure of claim 14, wherein the circuitry is adapted to intermittently illuminate a plurality of light emitting members disposed in the stopper portion.

17. A method of illuminating a bottle having a mouth providing access to an interior thereof, the method comprising:

inserting a stopper member having a light emitting member in the mouth of the bottle, the stopper member having an sealing member disposed on an outer surface of the stopper member to engage an inner surface of the bottle, wherein the sealing member seals contents contained in the interior of the bottle;

actuating an actuator assembly operatively coupled to the stopper member to illuminate the light emitting member; and wherein the interior of the bottle is illuminated.

18. The method of claim 17 further comprising inverting the bottle to actuate the actuating assembly and illuminating the light emitting member.

19. The method of claim 17 further comprising the step of exposing the actuator assembly to a stimulus, whereby the light emitting member is at least temporarily illuminated.

* * * * *